US010354591B2

(12) United States Patent
Zhou et al.

(10) Patent No.: US 10,354,591 B2
(45) Date of Patent: Jul. 16, 2019

(54) PIXEL DRIVING CIRCUIT, REPAIR METHOD THEREOF AND DISPLAY DEVICE

(71) Applicant: Shenzhen China Star Optoelectronics Semiconductor Display Technology Co., Ltd., Shenzhen (CN)

(72) Inventors: Xuebing Zhou, Shenzhen (CN); Yichien Wen, Shenzhen (CN); Mingjong Jou, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/570,379

(22) PCT Filed: Jul. 13, 2017

(86) PCT No.: PCT/CN2017/092683
§ 371 (c)(1),
(2) Date: Oct. 30, 2017

(87) PCT Pub. No.: WO2018/218742
PCT Pub. Date: Dec. 6, 2018

(65) Prior Publication Data

US 2018/0342206 A1 Nov. 29, 2018

(30) Foreign Application Priority Data

May 27, 2017 (CN) ..... 2017 1 0392077

(51) Int. Cl.
*G09G 3/3258* (2016.01)
*G09G 3/3291* (2016.01)
*G09G 3/3233* (2016.01)

(52) U.S. Cl.
CPC ..... *G09G 3/3258* (2013.01); *G09G 3/3233* (2013.01); *G09G 3/3291* (2013.01);
(Continued)

(58) Field of Classification Search
None
See application file for complete search history.

(56) References Cited

U.S. PATENT DOCUMENTS

2007/0195019 A1 8/2007 Ono et al.
2017/0061877 A1 3/2017 Lee
2017/0148389 A1* 5/2017 Zhou ..... G09G 3/3258

FOREIGN PATENT DOCUMENTS

CN 101075410 A 11/2007
CN 102110412 A 6/2011
(Continued)

*Primary Examiner* — Kenneth B Lee, Jr.
(74) *Attorney, Agent, or Firm* — Leong C. Lei

(57) ABSTRACT

The invention provides a pixel driving circuit, repair method thereof, and a display device. The pixel driving circuit comprises: a first TFT, a second TFT, a third TFT, a fourth TFT, a fifth TFT, a capacitor, a first electroluminescent device, and a second electroluminescent device; by controlling the fourth and fifth TFTs to turn on and off alternatingly through the light-emitting control signal, the first and second electroluminescent devices emit light alternatingly so as to reduce operation duration of the first and second electroluminescent devices and improve the lifespan of the first and second electroluminescent devices, as well as to ensure the pixel emitting light normally when one of the first and second electroluminescent devices malfunctions by adjusting the voltage of the light-emitting control signal so that the remaining functioning electroluminescent device continues to operate.

7 Claims, 5 Drawing Sheets

(52) U.S. Cl.
CPC ..... *G09G 2300/0804* (2013.01); *G09G 2300/0819* (2013.01); *G09G 2320/0295* (2013.01); *G09G 2320/0693* (2013.01); *G09G 2330/08* (2013.01)

(56) References Cited

FOREIGN PATENT DOCUMENTS

| | | | |
|---|---|---|---|
| CN | 102479485 | A | 5/2012 |
| CN | 103903559 | A | 7/2014 |
| CN | 103927973 | A | 7/2014 |
| CN | 104464644 | A | 3/2015 |
| CN | 105528997 | A | 4/2016 |

* cited by examiner

PIXEL DRIVING CIRCUIT, REPAIR METHOD THEREOF AND DISPLAY DEVICE

BACKGROUND OF THE INVENTION

1. Field of the Invention

The present invention relates to the field of display techniques, and in particular to a driving circuit, a repair method thereof, and a display device.

2. The Related Arts

As the display technology progress, the use of electroluminescent devices, such as, organic light emitting diode (OLED) or quantum dots light-emitting diode (QLED), as the light source in active-luminescent display is more and more popular, as the approach provides the advantages of high emission efficiency, quick response time, high resolution and contrast, near 180° viewing angle, wide operation temperature range, and capability to realize flexible display and large-area full-color display.

OLED and QLED are both electroluminescent device driven by electric current; that is, when a current flows through OLED or QLED, the OLED or OLED illuminates, and the brightness is determined by the current flowing through the OLED or QLED. The majority of known integrated circuit (IC) only transmits the voltage signal, and the pixel driving circuit of the OLED display or QLED display must accomplish the task of translating the voltage signal into a current signal. The conventional pixel driving circuit usually uses a 2T1C structure, i.e., two thin film transistors (TFT) and a capacitor, to translate the voltage into current.

As shown in FIG. 1, a conventional 2T1C pixel driving circuit for driving electroluminescent device comprises: a first TFT T10, second TFT T20, and a capacitor C10. The first TFT T10 is a switch TFT, the second TFT T20 is a driving TFT, and the capacitor T10 is a storage capacitor. Specifically, the first TFT T10 has a gate connected to receive a scan signal Scan, a source connected to receive a data signal Data, and a drain electrically connected to a gate of the second TFT T20 and to one end of the capacitor C10. The second TFT T20 has a drain connected to receive a positive voltage VDD of a power source, and a source connected to receive an anode of the electroluminescent device (OLED or QLED); the electroluminescent device has a cathode connected to receive a negative voltage VSS of the power source; the capacitor C10 has one end electrically connected to the drain of the first TFT T10 and the gate of the second TFT T20, and the other end electrically connected to the source of the second TFT T20 and the anode of the electroluminescent device.

For the display based on the above pixel driving circuit, the electroluminescent device always stays in a light-emitting state during usage, which results in accelerated ageing of the electroluminescent device and shortening the lifespan of the electroluminescent device. Moreover, when the electroluminescent device is damaged, there exists no effective way for repair and leads to the damaged pixel unable to emit light, resulting in degraded display quality and dark spot.

SUMMARY OF THE INVENTION

The object of the present invention is to provide a pixel driving circuit, able to reduce the duration of continuous operation and improve the lifespan of the electroluminescent device.

Another object of the present invention is to provide a repair method of pixel driving circuit, able to repair a malfunctioning electroluminescent in the pixel driving circuit.

Yet another object is to provide a display device, able to reduce the duration of continuous operation and improve the lifespan of the electroluminescent device.

To achieve the above object, the present invention provides a pixel driving circuit, comprising: a first thin film transistor (TFT), a second TFT, a third TFT, a fourth TFT, a fifth TFT, a capacitor, a first electroluminescent device, and a second electroluminescent device;

the first TFT having a gate connected to a first node, a drain connected to a power source positive voltage, and a source connected to a second node;

the second TFT having a gate connected to a sensing signal, a drain connected to the second node, and a source connected to a reference voltage;

the third TFT having a gate connected to a scan signal, a drain connected to a data signal, and source connected to the first node;

the fourth TFT having a gate connected to a light-emitting control signal, a drain connected to an anode of the second electroluminescent device, and a source connected to the second node;

the fifth TFT having a gate connected to the light-emitting control signal, a source connected to an anode of the first electroluminescent device, and a drain connected to the second node;

the capacitor having one end connected to the first node and the other end connected to the second node;

both the first electroluminescent device and the second electroluminescent device having a cathode connected to a power source negative voltage; the fourth TFT being one of N-type TFT or P-type TFT, and the fifth TFT being the other type of N-type TFT or P-type TFT different from the type of the fourth TFT.

According to a preferred embodiment of the present invention, the light-emitting control signal is a periodic pulse signal.

According to a preferred embodiment of the present invention, the first electroluminescent device and the second electroluminescent device are organic light-emitting diode (OLED) or quantum dots light-emitting diode (QLED).

The present invention also provides a repair method of pixel driving circuit, comprising the steps of:

Step 1: providing a pixel driving circuit, the pixel driving circuit comprising: a first thin film transistor (TFT), a second TFT, a third TFT, a fourth TFT, a fifth TFT, a capacitor, a first electroluminescent device, and a second electroluminescent device;

the first TFT having a gate connected to a first node, a drain connected to a power source positive voltage, and a source connected to a second node; the second TFT having a gate connected to a sensing signal, a drain connected to the second node, and a source connected to a reference voltage; the third TFT having a gate connected to a scan signal, a drain connected to a data signal, and source connected to the first node; the fourth TFT having a gate connected to a light-emitting control signal, a drain connected to an anode of the second electroluminescent device, and a source connected to the second node; the fifth TFT having a gate connected to the light-emitting control signal, a source connected to an anode of the first electroluminescent device, and a drain connected to the second node; the capacitor having one end connected to the first node and the other end connected to the second node; both the first electroluminescent device and the second electroluminescent device having a cathode connected to a power source negative voltage; the fourth TFT being one of N-type TFT or P-type TFT, and the fifth TFT being the other type of N-type TFT or P-type TFT different from the type of the fourth TFT; and Step 2: detecting whether the first electroluminescent device or the second electroluminescent device having a malfunction; if the first electroluminescent device malfunctioning, configuring the pixel driving circuit so that the light-emitting control signal controlling the fifth TFT always turned off and the fourth TFT always turned on during operation; and if the second electroluminescent device malfunctioning, configuring the pixel driving circuit so that the light-emitting control signal controlling the fifth TFT always turned on and the fourth TFT always turned off during operation.

According to a preferred embodiment of the present invention, the first electroluminescent device and the second electroluminescent device are organic light-emitting diode (OLED) or quantum dots light-emitting diode (QLED).

The present invention further provides a display device, comprising a plurality of sub-pixels arranged in an array, a plurality of parallel horizontal scan lines arranged spaced apart, a plurality of parallel horizontal sensing lines arranged spaced apart, a plurality of parallel vertical data lines arranged spaced apart, a plurality of parallel vertical light-emitting control lines arranged spaced apart, a data driving module, and a light-emitting control module;

each row of sub-pixels corresponding to one scan line and one sensing line; each column of sub-pixels corresponding to one data line and one light-emitting control line; the scan line, sensing line, data line, and light-emitting control line being for providing a scan signal, a sensing signal, a data signal, and a light-emitting control signal to the sub-pixel, respectively;

the data driving module comprising: a plurality of data signal output ends corresponding one-to-one to the plurality of data lines; the light-emitting control module comprising: a plurality of switches corresponding one-to-one to the plurality of the data lines, a light-emitting control signal input line connected to the plurality of light-emitting control lines, and a sensing signal output line; the switch having a first end connected to the data line corresponding to the switch, a second end connected to the data signal output end corresponding to the data line corresponding to the switch, and a third end connected to the sensing signal output line;

the sub-pixel comprising: a first thin film transistor (TFT), a second TFT, a third TFT, a fourth TFT, a fifth TFT, a capacitor, a first electroluminescent device, and a second electroluminescent device;

the first TFT having a gate connected to a first node, a drain connected to a power source positive voltage, and a source connected to a second node; the second TFT having a gate connected to a sensing signal, a drain connected to the second node, and a source connected to a reference voltage; the third TFT having a gate connected to a scan signal, a drain connected to a data signal, and source connected to the first node; the fourth TFT having a gate connected to a light-emitting control signal, a drain connected to an anode of the second electroluminescent device, and a source connected to the second node; the fifth TFT having a gate connected to the light-emitting control signal, a source connected to an anode of the first electroluminescent device, and a drain connected to the second node; the capacitor having one end connected to the first node and the other end connected to the second node; both the first electroluminescent device and the second electroluminescent device having a cathode connected to a power source negative voltage; the fourth TFT being one of N-type TFT or P-type TFT, and the fifth TFT being the other type of N-type TFT or P-type TFT different from the type of the fourth TFT.

According to a preferred embodiment of the present invention, the display device further comprises a scan driving module, a sensing driving module, a sensing translation module, and a timing controller;

the data driving module, light-emitting control module, scan driving module, sensing driving module, and sensing translation module are all connected to the timing controller; the sensing translation module is connected to the light-emitting control module.

According to a preferred embodiment of the present invention, the light-emitting control signal line is disposed with a plurality of cascaded D-triggers, with each D-trigger corresponding and connected to a light-emitting control line.

According to a preferred embodiment of the present invention, the light-emitting control signal is a periodic pulse signal.

According to a preferred embodiment of the present invention, the first electroluminescent device and the second electroluminescent device are organic light-emitting diode (OLED) or quantum dots light-emitting diode (QLED).

Compared to the known techniques, the present invention provides the following advantages. The present invention provides a pixel driving circuit, repair method thereof, and a display device. The pixel driving circuit comprises: a first TFT, a second TFT, a third TFT, a fourth TFT, a fifth TFT, a capacitor, a first electroluminescent device, and a second electroluminescent device; by controlling the fourth and fifth TFTs to turn on and off alternatingly through the light-emitting control signal, the first and second electroluminescent devices emit light alternatingly so as to reduce operation duration of the first and second electroluminescent devices and improve the lifespan of the first and second electroluminescent devices, as well as to ensure the pixel emitting light normally when one of the first and second electroluminescent devices malfunctions by adjusting the voltage of the light-emitting control signal so that the remaining functioning electroluminescent device continues to operate.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
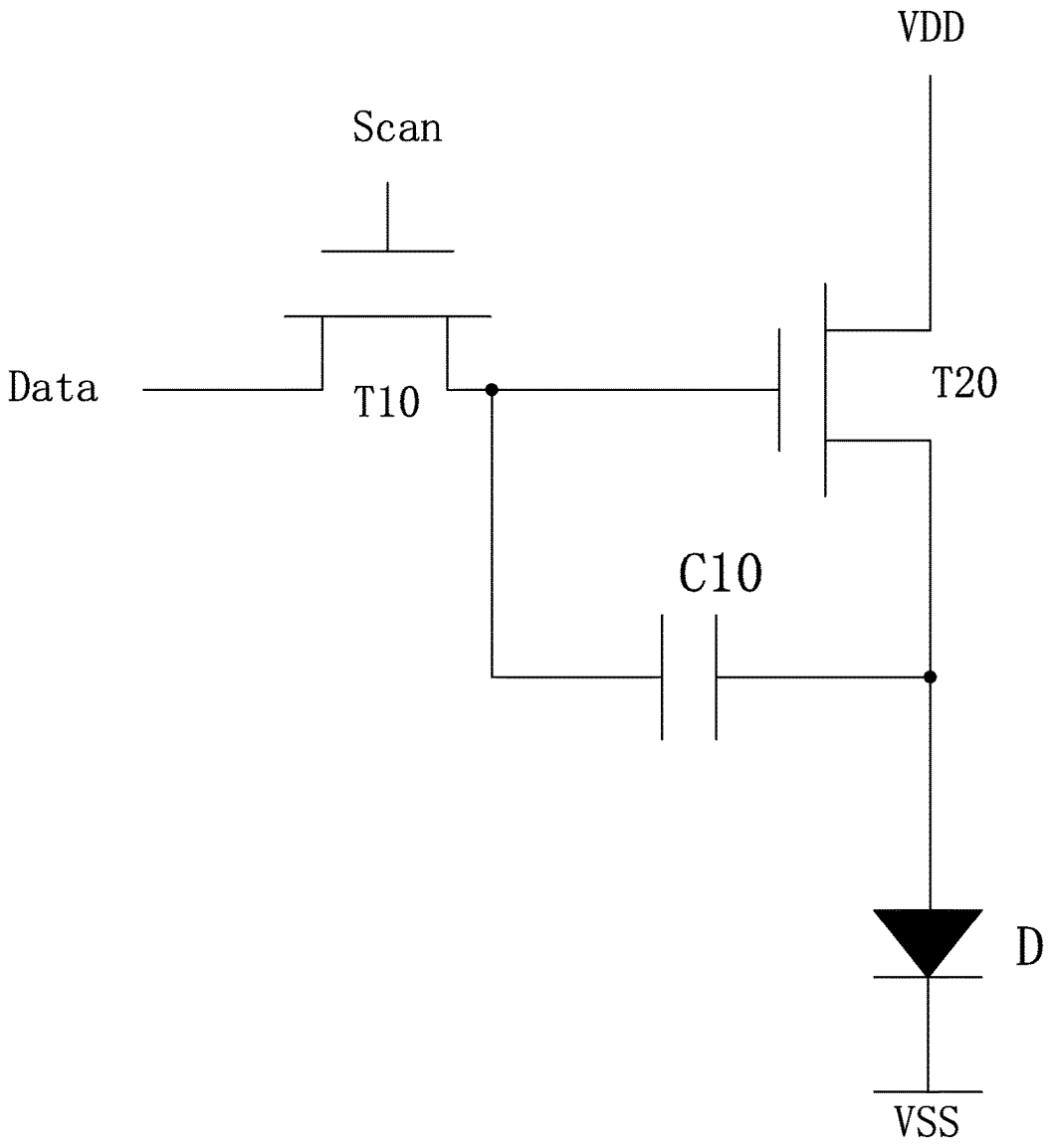
FIG. 1 is a schematic view showing a conventional pixel driving circuit.
Figure 2:
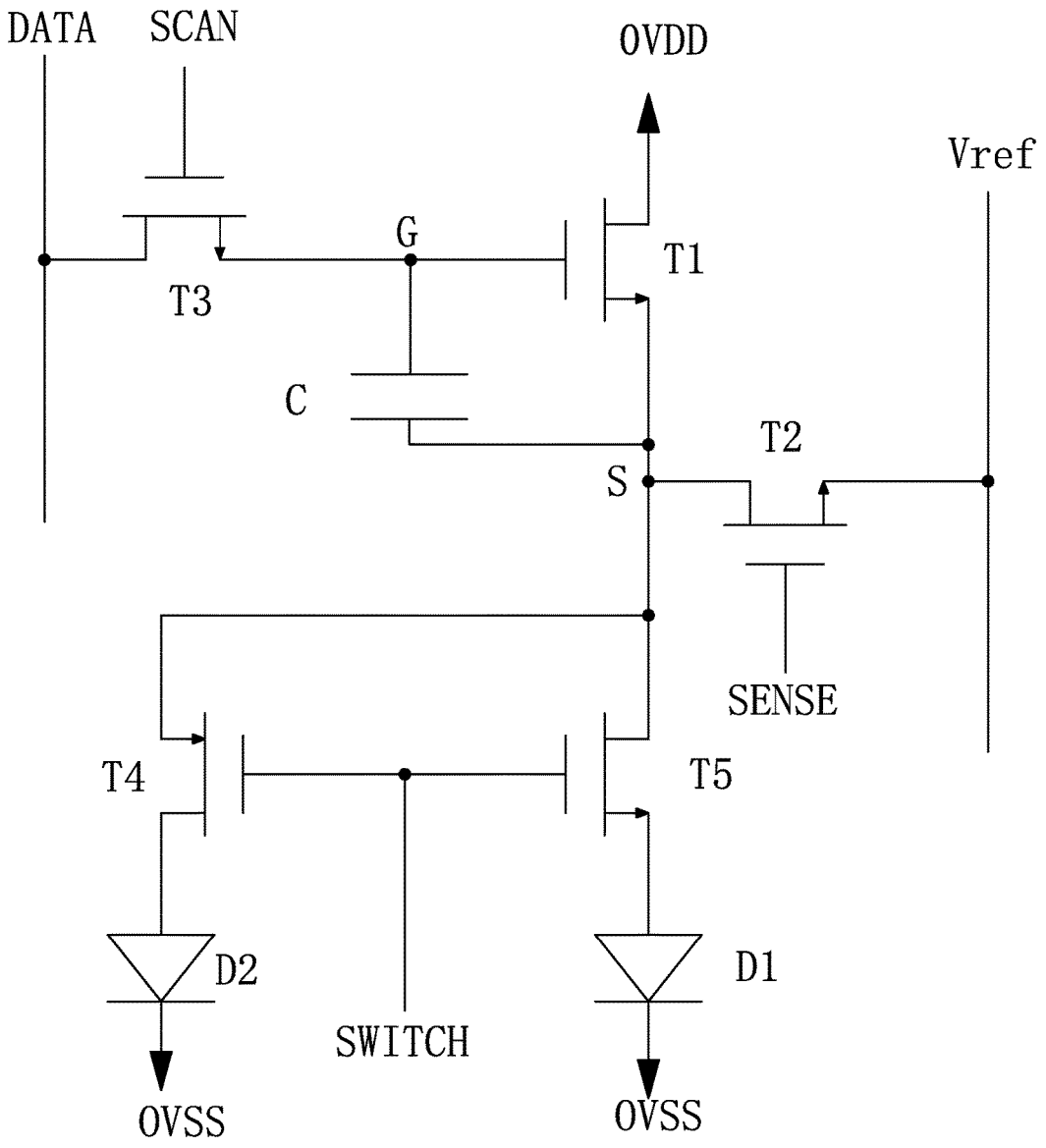
FIG. 2 is a schematic view showing a pixel driving circuit provided by an embodiment of the present invention.

Referring to FIG. 2, the present invention provides a pixel driving circuit, comprising: a first thin film transistor (TFT) T1, a second TFT T2, a third TFT T3, a fourth TFT T4, a fifth TFT T5, a capacitor C, a first electroluminescent device D1, and a second electroluminescent device D2; the first TFT having a gate connected to a first node G, a drain connected to a power source positive voltage OVDD, and a source connected to a second node S; the second TFT T2 having a gate connected to a sensing signal SENSE, a drain connected to the second node S, and a source connected to a reference voltage Vref; the third TFT T3 having a gate connected to a scan signal SCAN, a drain connected to a data signal DATA, and source connected to the first node G; the fourth TFT T4 having a gate connected to a light-emitting control signal SWITCH, a drain connected to an anode of the second electroluminescent device D2, and a source connected to the second node S; the fifth TFT T5 having a gate connected to the light-emitting control signal SWITCH, a source connected to an anode of the first electroluminescent device D1, and a drain connected to the second node S; the capacitor C having one end connected to the first node G and the other end connected to the second node S; both the first electroluminescent device D1 and the second electroluminescent device D2 having a cathode connected to a power source negative voltage OVSS; the fourth TFT T4 being one of N-type TFT or P-type TFT, and the fifth TFT T5 being the other type of N-type TFT or P-type TFT different from the type of the fourth TFT T4.

Specifically, the light-emitting control signal SWITCH is a periodic pulse signal. By switching the voltage levels of the light-emitting control signal SWITCH, the fourth TFT T4 and the fifth TFT T5 turn on and off alternatingly, and the first and second electroluminescent devices emit light alternatingly so as to reduce operation duration of each single electroluminescent device and improve the lifespan of the first and second electroluminescent devices. Preferably, the light-emitting control signal SWITCH is provided by an external timing controller.

Preferably, the first electroluminescent device D1 and the second electroluminescent device D2 are organic light-emitting diode (OLED) or quantum dots light-emitting diode (QLED).

Figure 5:
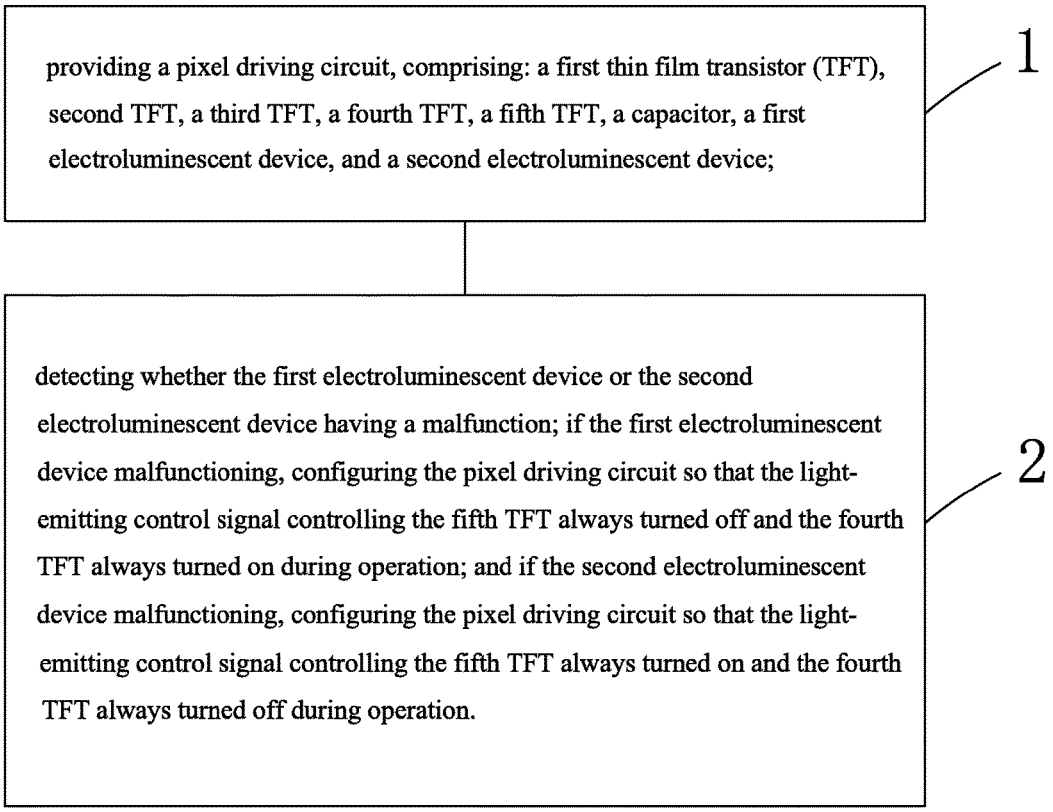
FIG. 5 is a schematic view showing a flowchart of repair method of the pixel driving circuit provided by an embodiment of the present invention.

Refer to FIG. 5. Based on the above pixel driving circuit, the present invention also provides a repair method of pixel driving circuit, comprising the steps of:

Step 1: referring to FIG. 2, providing a pixel driving circuit. Specifically, the pixel driving circuit is as described above.

Step 2: detecting whether the first electroluminescent device D1 or the second electroluminescent device D2 having a malfunction; if the first electroluminescent device D1 malfunctioning, configuring the pixel driving circuit so that the light-emitting control signal SWITCH controlling the fifth TFT T5 always turned off and the fourth TFT T4 always turned on during operation; and if the second electroluminescent device D2 malfunctioning, configuring the pixel driving circuit so that the light-emitting control signal SWITCH controlling the fifth TFT T5 always turned on and the fourth TFT T4 always turned off during operation.

Specifically, in Step 2, by turning on the second TFT T2 and the third TFT T3, the data signal DATA and the reference voltage Vref are written to the gate and source of the first TFT T1 respectively; then, the light-emitting control signal SWITCH controls the fourth TFT T4 to turn on and obtain the sensing data of the second electroluminescent device D2, and then the light-emitting control signal SWITCH controls the fifth TFT T5 to turn on and obtain the sensing data of the first electroluminescent device D1; then, the sensing data of the first electroluminescent device D1 and the sensing data of the second electroluminescent device D2 are analyzed to determine analyzing whether there exist abnormal data, and the electroluminescent device with abnormal sensing data is determined to be malfunctioning.

Preferably, the first electroluminescent device D1 and the second electroluminescent device D2 are OLED or QLED.

Figure 3:
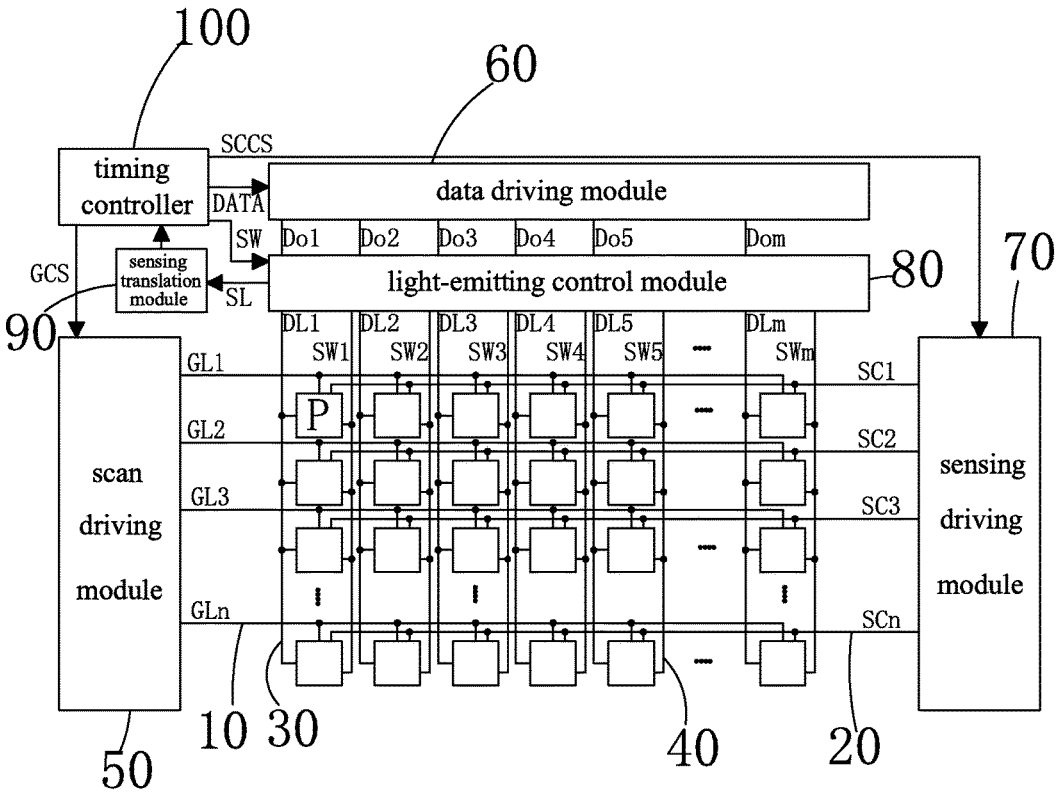
FIG. 3 is a schematic view showing a display device provided by an embodiment of the present invention.
Figure 4:
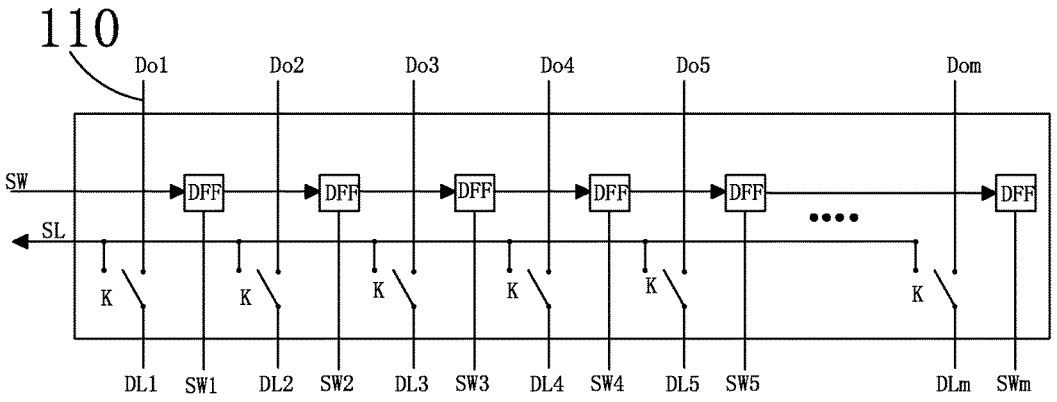
FIG. 4 is a schematic view a light-emitting control module of the display device provided by an embodiment of the present invention.

Refer to FIG. 3 and FIG. 4. Based on the above pixel driving circuit, the present invention further provides a display device, comprising a plurality of sub-pixels P arranged in an array, the plurality of sub-pixels comprising the aforementioned pixel driving circuit; a plurality of parallel horizontal scan lines 10 arranged spaced apart, such as GL1, GL2, GL3, GLn, and so on; a plurality of parallel horizontal sensing lines 20 arranged spaced apart, such as, SC1, SC2, SC3, SCn, and son on; a plurality of parallel vertical data lines 30 arranged spaced apart, such as, DL1, DL2, DL3, DL4, DL5, DLm, and so on; a plurality of parallel vertical light-emitting control lines 40 arranged spaced apart, such as, SW1, SW2, SW3, SW4, SW5, SWm, and so on; a scan driving module 50, a sensing driving module 70, a sensing translation module 90, a timing controller 100, a data driving module 60, and a light-emitting control module 80.

Specifically, each row of sub-pixels P corresponds to one scan line 10 and one sensing line 20; each column of sub-pixels P corresponds to one data line 30 and one light-emitting control line 40; the scan line 10, sensing line 20, data line 30, and light-emitting control line 40 are for providing a scan signal SCAN, a sensing signal SENSE, a data signal DATA, and a light-emitting control signal SWITCH to the sub-pixel P, respectively.

Furthermore, the data driving module 60 comprises: a plurality of data signal output ends 110 corresponding one-to-one to the plurality of data lines 30, such as, Do1, Do2, Do3, Do4, Do5, Dom, and so on. Refer to FIG. 4. The light-emitting control module 80 comprises: a plurality of switches K corresponding one-to-one to the plurality of the data lines 30, a light-emitting control signal input line SW connected to the plurality of light-emitting control lines 40, and a sensing signal output line SL.

Wherein, the switch K is a single port double throw (SPDT) switch, comprising: a first end, a second end, and a third end. The first end is connected to the data line 30 corresponding to the switch K, the second end is connected to the data signal output end 110 corresponding to the data line 30 corresponding to the switch L, and the third end is connected to the sensing signal output line SL.

Moreover, the light-emitting control signal line SW is disposed with a plurality of cascaded D-triggers DFF, with each D-trigger DFF corresponding and connected to a light-emitting control line 40.

Specifically, the data driving module 60, light-emitting control module 80, scan driving module 50, sensing driving module 70, and sensing translation module 90 are all connected to the timing controller 100; the sensing translation module 90 is connected to the light-emitting control module 80.

Wherein, the timing controller 100 is for controlling the timing and the data processing of the entire display device, the operations of the data driving module 60, light-emitting control module 80, scan driving module 50, and sensing driving module 70. Specifically, the processing comprises: in a sensing phase, receiving the sensing data from the sensing translation module 90 and performing calculation to obtain a compensation data, and storing the compensation data; in a display phase, receiving a normal image data, reading corresponding compensation data from storage, performing compensation to obtain compensated image data, and generating data signal DATA after data rearrangement to transmit to the data driving module 60. Furthermore, the timing controller 100 is also used to provide a driving signal SCCS of the sensing signal to the sensing driving module 70, a driving signal GCS of the scan signal SCAN to the scan driving module 50, a driving signal of the light-emitting control signal SWITCH to the light-emitting control signal output line SW of the light-emitting control module 80.

Specifically, in the sensing phase, the light-emitting control module 80 controls the data line 30 to connect to the sensing signal output line SL according to the driving signal of the light-emitting control signal SWITCH; while in the display phase, the light-emitting control module 80 transmits the light-emitting control signal SWITCH to each light-emitting control line 40 according to the driving signal of the light-emitting control signal SWITCH, and connects each data line correspondingly to the data signal output end 110 corresponding to the data line 30. That is, in the sensing phase, each switch K have the first end and the third end electrically connected, and in the display phase, each switch K has the first end and the second end electrically connected.

Optionally, the scan driving module 50 and the sensing driving module 70 can be two independent driving circuits, or integrated into the same driving circuit. The data driving module 60 and the light-emitting control module 80 can be two independent driving circuits, or integrated into the same driving circuit. The light-emitting control module 80 can also be integrated into the timing controller 100.

Specifically, the light-emitting control signal SWITCH is a periodic pulse signal. By switching the voltage levels of the light-emitting control signal SWITCH, the fourth TFT T4 and the fifth TFT T5 turn on and off alternatingly, and the first and second electroluminescent devices emit light alternatingly so as to reduce operation duration of each single electroluminescent device and improve the lifespan of the first and second electroluminescent devices. Preferably, the first electroluminescent device D1 and the second electroluminescent device D2 are organic light-emitting diode (OLED) or quantum dots light-emitting diode (QLED).

In summary, the present invention provides a pixel driving circuit, repair method thereof, and a display device. The pixel driving circuit comprises: a first TFT, a second TFT, a third TFT, a fourth TFT, a fifth TFT, a capacitor, a first electroluminescent device, and a second electroluminescent device; by controlling the fourth and fifth TFTs to turn on and off alternatingly through the light-emitting control signal, the first and second electroluminescent devices emit light alternatingly so as to reduce operation duration of the first and second electroluminescent devices and improve the lifespan of the first and second electroluminescent devices, as well as to ensure the pixel emitting light normally when one of the first and second electroluminescent devices malfunctions by adjusting the voltage of the light-emitting control signal so that the remaining functioning electroluminescent device continues to operate.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A repair method of pixel driving circuit, comprising the steps of:

Step 1: providing a pixel driving circuit, the pixel driving circuit comprising: a first thin film transistor (TFT), a second TFT, a third TFT, a fourth TFT, a fifth TFT, a capacitor, a first electroluminescent device, and a second electroluminescent device;

the first TFT having a gate connected to a first node, a drain connected to a power source positive voltage, and a source connected to a second node; the second TFT having a gate connected to a sensing signal, a drain connected to the second node, and a source connected to a reference voltage; the third TFT having a gate connected to a scan signal, a drain connected to a data signal, and source connected to the first node; the fourth TFT having a gate connected to a light-emitting control signal, a drain connected to an anode of the second electroluminescent device, and a source connected to the second node; the fifth TFT having a gate connected to the light-emitting control signal, a source connected to an anode of the first electroluminescent device, and a drain connected to the second node; the capacitor having one end connected to the first node and the other end connected to the second node; both the first electroluminescent device and the second electroluminescent device having a cathode connected to a power source negative voltage; the fourth TFT being one of N-type TFT or P-type TFT, and the fifth TFT being the other type of N-type TFT or P-type TFT different from the type of the fourth TFT; and Step 2: detecting whether the first electroluminescent device or the second electroluminescent device having a malfunction; if the first electroluminescent device malfunctioning, configuring the pixel driving circuit so that the light-emitting control signal controlling the fifth TFT always turned off and the fourth TFT always turned on during operation; and if the second electroluminescent device malfunctioning, configuring the pixel driving circuit so that the light-emitting control signal controlling the fifth TFT always turned on and the fourth TFT always turned off during operation.

2. The repair method of pixel driving circuit as claimed in claim 1, wherein the first electroluminescent device and the second electroluminescent device are organic light-emitting diode (OLED) or quantum dots light-emitting diode (QLED).

3. A display device, comprising a plurality of sub-pixels arranged in an array, a plurality of parallel horizontal scan lines arranged spaced apart, a plurality of parallel horizontal sensing lines arranged spaced apart, a plurality of parallel vertical data lines arranged spaced apart, a plurality of parallel vertical light-emitting control lines arranged spaced apart, a data driving module, and a light-emitting control module; each row of sub-pixels corresponding to one scan line and one sensing line;

each column of sub-pixels corresponding to one data line and one light-emitting control line; the scan line, sensing line, data line, and light-emitting control line being for providing a scan signal, a sensing signal, a data signal, and a light-emitting control signal to the sub-pixel, respectively;

the data driving module comprising: a plurality of data signal output ends corresponding one-to-one to the plurality of data lines; the light-emitting control module comprising: a plurality of switches corresponding one-to-one to the plurality of the data lines, a light-emitting control signal input line connected to the plurality of light-emitting control lines, and a sensing signal output line; the switch having a first end connected to the data line corresponding to the switch, a second end connected to the data signal output end corresponding to the data line corresponding to the switch, and a third end connected to the sensing signal output line;

the sub-pixel comprising: a first thin film transistor (TFT), a second TFT, a third TFT, a fourth TFT, a fifth TFT, a capacitor, a first electroluminescent device, and a second electroluminescent device;

the first TFT having a gate connected to a first node, a drain connected to a power source positive voltage, and a source connected to a second node; the second TFT having a gate connected to a sensing signal, a drain connected to the second node, and a source connected to a reference voltage; the third TFT having a gate connected to a scan signal, a drain connected to a data signal, and source connected to the first node; the fourth TFT having a gate connected to a light-emitting control signal, a drain connected to an anode of the second electroluminescent device, and a source connected to the second node; the fifth TFT having a gate connected to the light-emitting control signal, a source connected to an anode of the first electroluminescent device, and a drain connected to the second node; the capacitor having one end connected to the first node and the other end connected to the second node; both the first electroluminescent device and the second electroluminescent device having a cathode connected to a power source negative voltage; the fourth TFT being one of N-type TFT or P-type TFT, and the fifth TFT being the other type of N-type TFT or P-type TFT different from the type of the fourth TFT.

4. The display device as claimed in claim 3, wherein the display device further comprises a scan driving module, a sensing driving module, a sensing translation module, and a timing controller;

the data driving module, light-emitting control module, scan driving module, sensing driving module, and sensing translation module are all connected to the timing controller; the sensing translation module is connected to the light-emitting control module.

5. The display device as claimed in claim 3, wherein the light-emitting control signal line is disposed with a plurality of cascaded D-triggers, with each D-trigger corresponding and connected to a light-emitting control line.

6. The display device as claimed in claim 3, wherein the light-emitting control signal is a periodic pulse signal.

7. The display device as claimed in claim 3, wherein the first electroluminescent device and the second electroluminescent device are organic light-emitting diode (OLED) or quantum dots light-emitting diode (QLED).

* * * * *